US008109410B2

(12) United States Patent
Collins et al.

(10) Patent No.: US 8,109,410 B2
(45) Date of Patent: Feb. 7, 2012

(54) ANTI-PILFERING DEVICE FOR A VENDING MACHINE

(75) Inventors: Bryan Alan Collins, New Ellenton, SC (US); Charles Wayne Percy, Aiken, SC (US); Kevin A. Poyck, Lexington, SC (US); Gregory Scott Sullivan, N. Augusta, SC (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 362 days.

(21) Appl. No.: 11/881,244

(22) Filed: Jul. 26, 2007

(65) Prior Publication Data

US 2008/0251527 A1 Oct. 16, 2008

Related U.S. Application Data

(62) Division of application No. 10/788,303, filed on Mar. 1, 2004, now Pat. No. 7,264,138.

(51) Int. Cl.
*B65H 3/00* (2006.01)
*G07F 11/00* (2006.01)

(52) U.S. Cl. ..... 221/191; 221/15; 221/124; 221/194; 221/196; 221/253; 49/68; 49/94; 49/110; 49/114

(58) Field of Classification Search ..... 221/15, 221/124, 191, 194, 195, 196, 253; 49/68, 49/94, 110, 114
See application file for complete search history.

(56) References Cited

U.S. PATENT DOCUMENTS

| | | | | |
|---|---|---|---|---|
| 2,089,709 | A * | 8/1937 | Rabkin | 312/35 |
| 3,269,595 | A * | 8/1966 | Krakauer et al. | 221/75 |
| 3,276,624 | A | 10/1966 | Payne | |
| 3,869,064 | A * | 3/1975 | Payne | 221/19 |
| 4,036,400 | A | 7/1977 | Oden | |
| 4,094,440 | A * | 6/1978 | Lotspeich | 221/12 |
| 4,180,183 | A * | 12/1979 | Muller | 221/194 |
| 4,296,872 | A * | 10/1981 | Mitchell et al. | 221/195 |
| 4,354,615 | A | 10/1982 | Lindsey | |
| 4,509,658 | A | 4/1985 | Oden | |
| 4,511,059 | A | 4/1985 | Manzer | |
| 4,735,344 | A * | 4/1988 | Wuethrich | 221/194 |
| 4,823,984 | A * | 4/1989 | Ficken | 221/96 |
| 5,431,338 | A * | 7/1995 | Ashkenazi | 232/57.5 |
| 5,505,332 | A * | 4/1996 | Vogelpohl et al. | 221/1 |
| 5,909,823 | A * | 6/1999 | Ranft et al. | 221/129 |
| 5,927,539 | A | 7/1999 | Truitt et al. | |

(Continued)

FOREIGN PATENT DOCUMENTS

JP 405054248 A 3/1993

(Continued)

*Primary Examiner* — Gene O. Crawford
*Assistant Examiner* — Rakesh Kumar

(57) ABSTRACT

A vending machine includes a storage/display region, a dispensing chamber including a product access opening, and an anti-pilfer device that prevents unauthorized removal of products from the storage/display region through the product access opening. A delivery door is provided which can be shifted from a closed position to an open position to enable the removal of products from the dispensing chamber. The anti-pilfer device includes a plate coupled to a lower portion of the delivery door. When the delivery door is moved from the closed position, the anti-pilfer plate shifts, over a guide element, into a position that prevents products from being withdrawn from the storage/display area. Preferably, the storage/display region and dispensing chamber are separated by a product door, with the anti-pilfer plate preventing the product door from opening when the delivery door is shifted from the closed position.

20 Claims, 4 Drawing Sheets

U.S. PATENT DOCUMENTS

| | | | | |
|---|---|---|---|---|
| 6,321,936 | B1 | 11/2001 | Feltrin | |
| 6,386,389 | B1 * | 5/2002 | Percy et al. | 221/155 |
| 6,494,342 | B1 * | 12/2002 | Wittern et al. | 221/192 |
| 7,264,138 | B2 * | 9/2007 | Collins et al. | 221/191 |
| 2002/0017531 | A1 * | 2/2002 | Adriani | 221/15 |
| 2002/0145003 | A1 | 10/2002 | Nicolini | |

FOREIGN PATENT DOCUMENTS

| | | | |
|---|---|---|---|
| JP | 2001-216559 | A | 8/2001 |
| JP | 2002-0150378 | A | 5/2002 |
| JP | 2003-132409 | A | 5/2003 |

* cited by examiner

ANTI-PILFERING DEVICE FOR A VENDING MACHINE

This application is a divisional of prior U.S. patent application Ser. No. 10/788,303 filed on Mar. 1, 2004 now U.S. Pat. No. 7,264,138.

BACKGROUND OF THE INVENTION

1. Field of the Invention

The present invention pertains to the art of vending machines and, more particularly, to an anti-pilfering device that prevents unauthorized removal of products from a vending machine.

2. Discussion of the Prior Art

Certain types of vending machines include a glass front that covers a storage/display region. After a consumer makes a selection and deposits currency into an appropriate receptacle, the selected product is moved from the storage/display region to a dispensing chamber of the vending machine. Typically, the dispensing chamber is accessed through a product delivery door provided on a bottom, front portion of the vending machine.

In order to retrieve the selected product, the consumer must push the product delivery door open. Generally, the product delivery door is hinged at an upper portion and coupled to an anti-pilfer device. As the door is opened, a mechanism, interconnecting the door and the anti-pilfer device, causes the anti-pilfer device to close off access to the storage/display region. The mechanism moves the anti-pilfer device quickly so that opening the product delivery door will begin to shift a plate or door to completely cut-off access to the storage/display region. However, in many cases, opening the product delivery door slightly will provide enough room for a tool to be inserted up into the storage/display section to remove a product. In addition, and particularly in the area of beverage vending machines, it is becoming increasingly difficult to provide a dispensing chamber large enough to accommodate the increased size of product containers while, at the same time, providing an anti-pilfer mechanism that moves quickly using very little force.

Based on the above, there still exists a need in the art for a fully effective anti-pilfering device for a vending machine. More specifically, there exists a need for an anti-pilfering device for a vending machine having a large dispensing chamber that can be quickly shifted into a position that prevents unauthorized access to product using minimal activating force.

SUMMARY OF THE INVENTION

The present invention is directed to a vending machine including a product storage area, a dispensing chamber in communication with the product storage area, and a product access opening for removal of products transferred to the dispensing chamber from the product storage area. A delivery door is pivotally mounted to an upper edge of the product access opening. More specifically, the delivery door is adapted to shift from a closed position to an open position to facilitate the removal of products from the dispensing chamber. In accordance with a preferred embodiment of the present invention, an anti-pilfer plate is coupled to a lower portion of the delivery door. When the delivery door is shifted from the closed position, the anti-pilfer plate shifts into a position that prevents products from being withdrawn from the storage area.

In further accordance with the invention, a product door is pivotally mounted between the product storage area and the dispensing chamber. Preferably, the product door includes a seal provided about the product door to prevent the passage of refrigerated air from the storage area into the dispensing chamber. The product door is arranged so that, when the delivery door is moved from the closed position, the anti-pilfer plate shifts into a position so as to prevent the product door from opening.

In still further accordance with the invention, the anti-pilfer plate is directed into the position that prevents unauthorized access to the product storage area through the use of at least one guide element projecting from at least one side wall of the dispensing chamber. The anti-pilfer plate projects from a bottom edge portion of the delivery door and rests upon the guide elements. When the product door is moved from the closed position, the anti-pilfer plate is directed over the guide elements into a position that prevents unauthorized retrieval of stored products.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
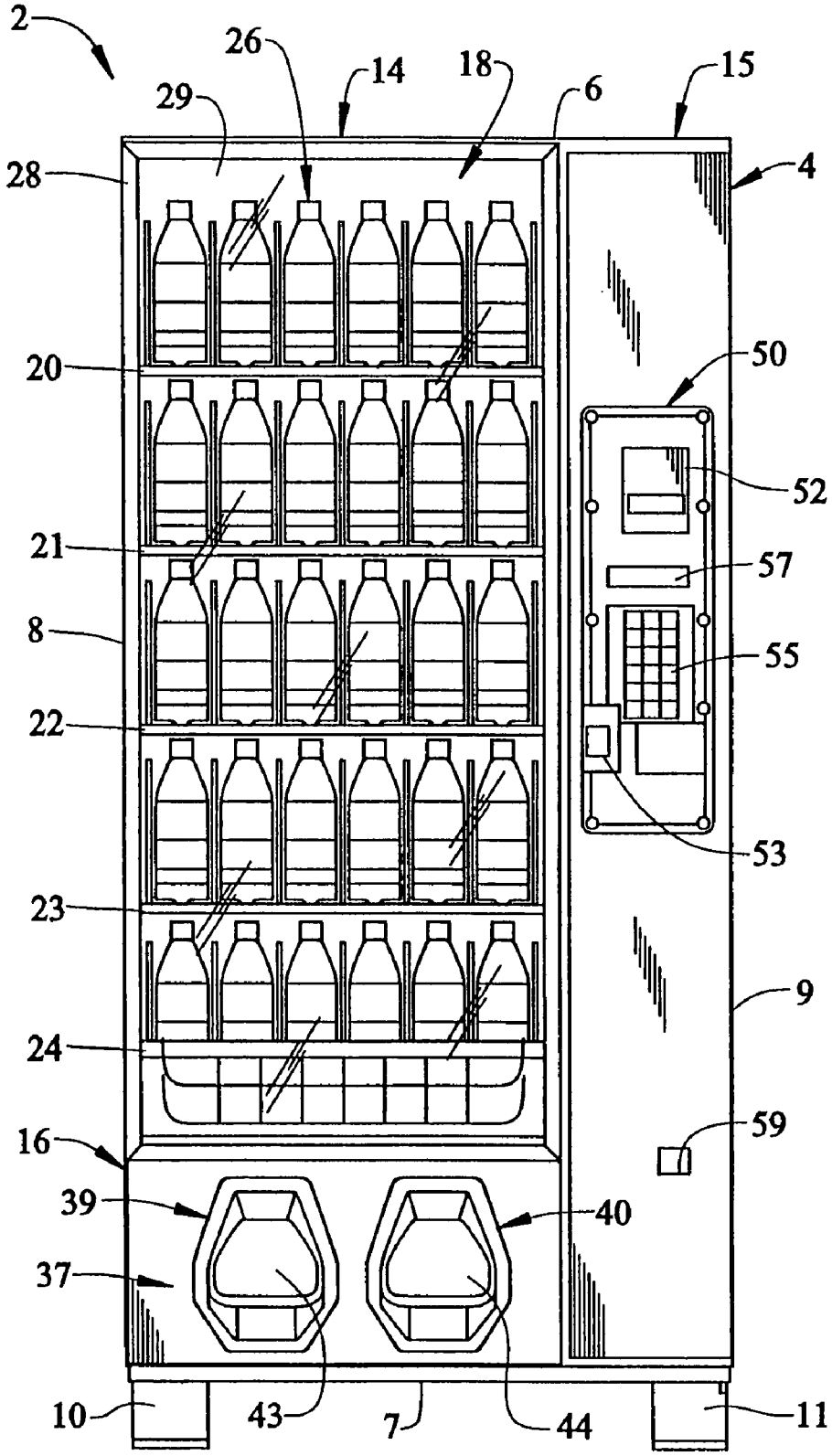
FIG. 1 is a front elevational view of a vending machine including an anti-pilfer device constructed in accordance with the present invention.

With initial reference to FIG. 1, a vending machine generally indicated at 2 includes a cabinet frame 4. As shown, cabinet frame 4 includes top, bottom and opposing side walls 6-9. Arranged below bottom wall 7 are a pair of leg members 10 and 11 for positioning vending machine 2 upon a supporting surface (not shown). In the preferred embodiment shown, vending machine 2 is divided into a plurality of zones for performing various functions associated with the delivery of products to a consumer. Toward that end, vending machine 2 includes a storage and display zone 14, a currency receiving zone 15 and a dispensing zone 16.

In the embodiment shown, storage/display zone 14 is provided with a plurality of product support shelves 20-24 for supporting and displaying a plurality of product containers, one of which is indicated at 26. Each of the plurality of product support shelves 20-24 includes an associated plurality of dispensing mechanisms (not shown) for delivering each product container 26 from storage/display zone 14 to dispensing zone 16. The actual construction and operation of the dispensing mechanisms does not constitute part of the present invention. Instead, various known dispensing mechanisms could be employed, including that set forth in detail in commonly assigned U.S. Pat. No. 6,571,988 entitled "Article Release Mechanism For a Vending Machine" issued on Jun.

3, 2003. Again, it should be understood that various other dispensing mechanisms could be employed, such as coils for prepackaged food items. In a manner known in the art, storage/display zone 14 is provided with a door 28 having a glass panel 29 to enable a consumer to view and choose between the variety of product containers 26 carried within vending machine 2.

In accordance with the embodiment shown, dispensing zone 16 is arranged below storage/display zone 14 and includes a dispensing chamber 37 having a plurality of product access openings 39 and 40 that enable the consumer to remove a dispensed product from dispensing chamber 37. As will be discussed more fully below, product access openings 39 and 40 are provided with delivery doors 43 and 44 respectively, which are pivotally mounted to dispensing chamber 37 so as to be shiftable between a first position, effectively closing off product access openings 39 and 40, and a second position, enabling the retrieval of a dispensed product from dispensing chamber 37.

Arranged alongside storage/display zone 14 and dispensing zone 16 is currency receiving zone 15. In the embodiment shown, currency receiving zone 15 includes a currency receiving center 50 for inputting and storing currency deposited by the consumer during a vend transaction. Currency receiving center 50 includes a bill acceptor/validator 52, a multi-price coin mechanism 53 and a key pad 55 for inputting particular product selections. Currency receiving center 50 also includes a display 57 for providing information to the consumer, as well as validating the particular selection made. Finally, a coin return slot 59 is provided for returning any required change to the consumer at the completion of a vend operation.

Figure 2:
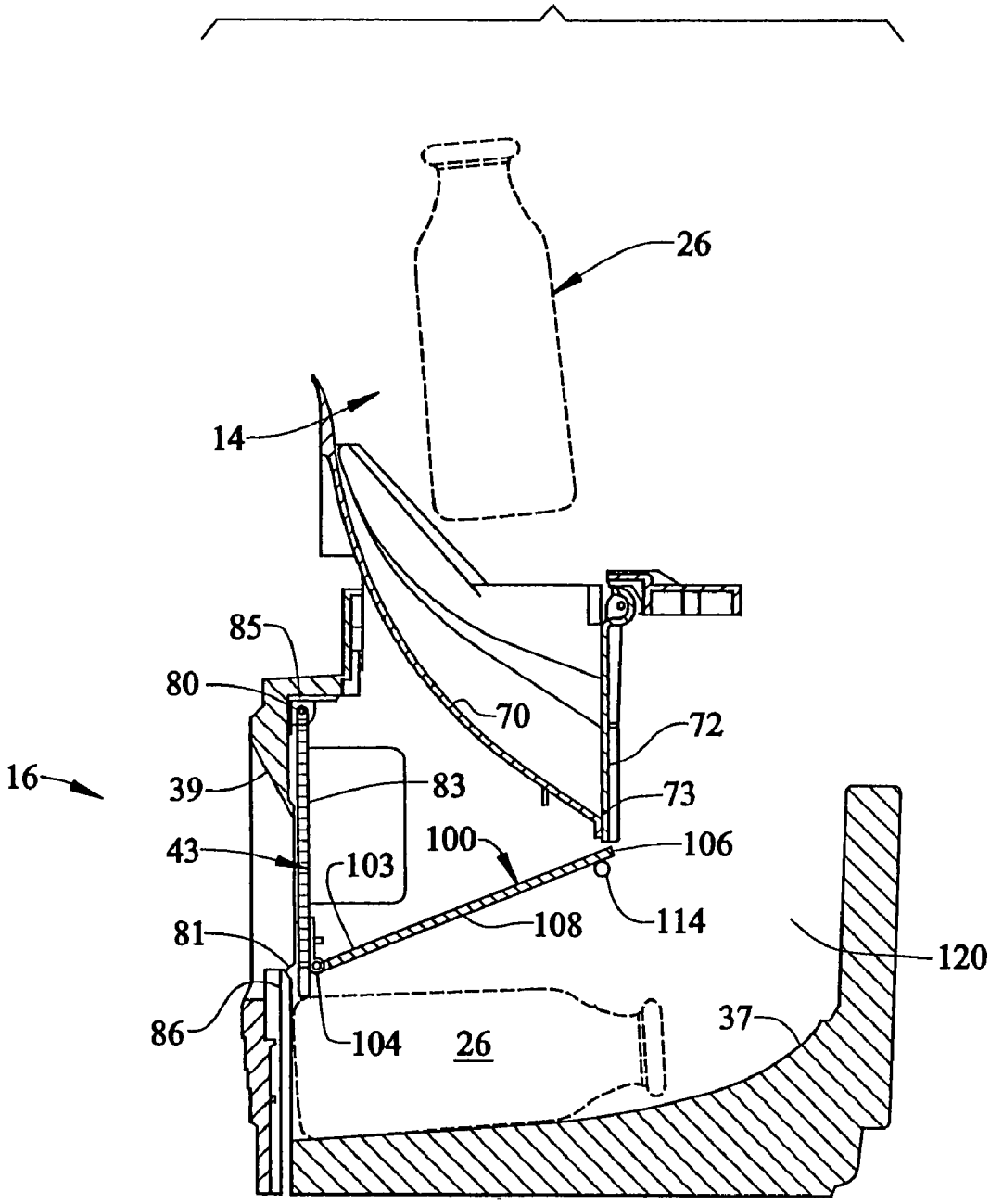
FIG. 2 is a partial, cross-sectional view of a dispensing chamber of the vending machine of FIG. 1, showing the anti-pilfer in a first or product dispensing position.
Figure 3:
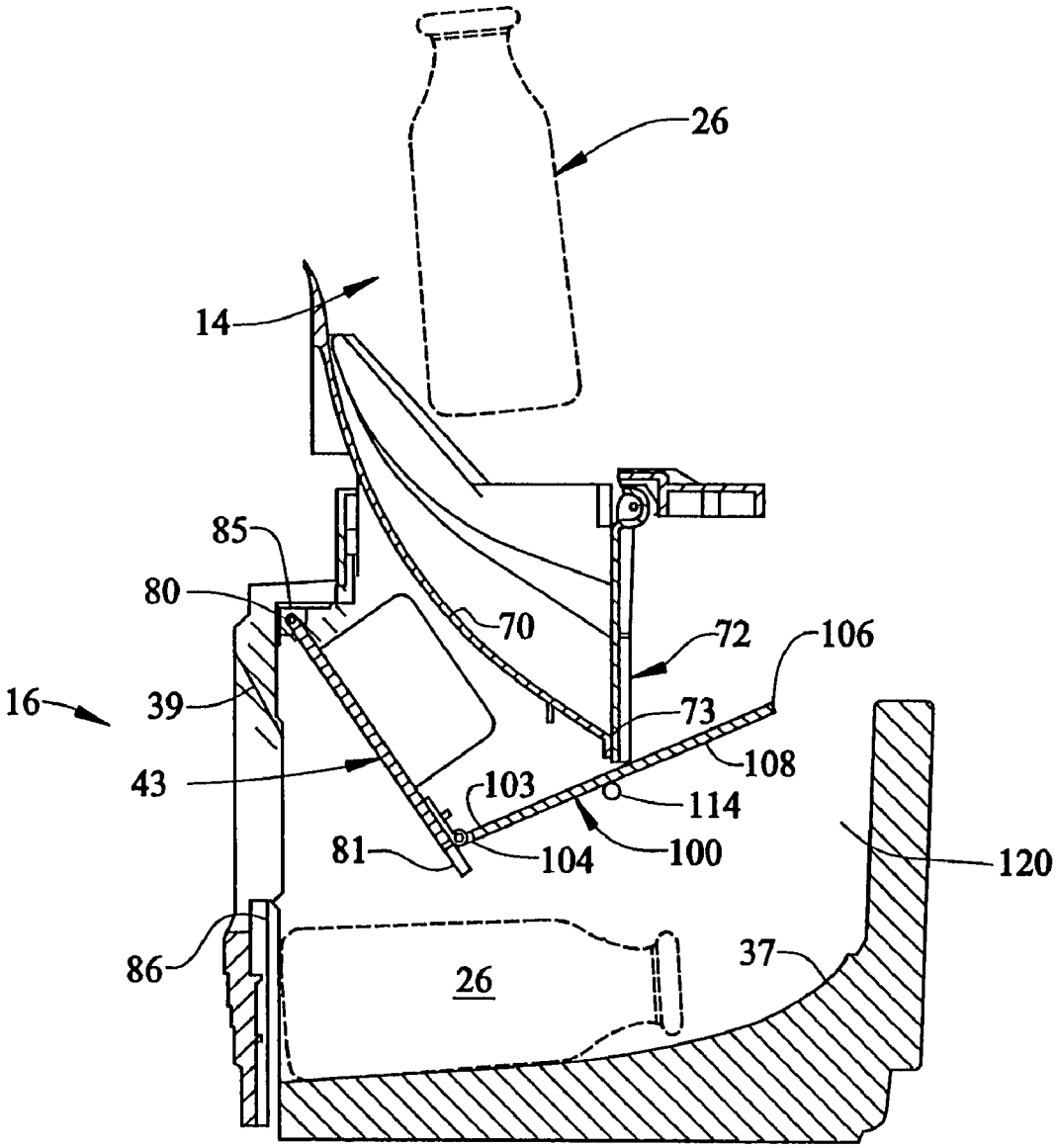
FIG. 3 is a partial, cross-sectional view of the dispensing chamber of FIG. 2, showing the anti-pilfer plate moving from the product dispensing position.
Figure 4:
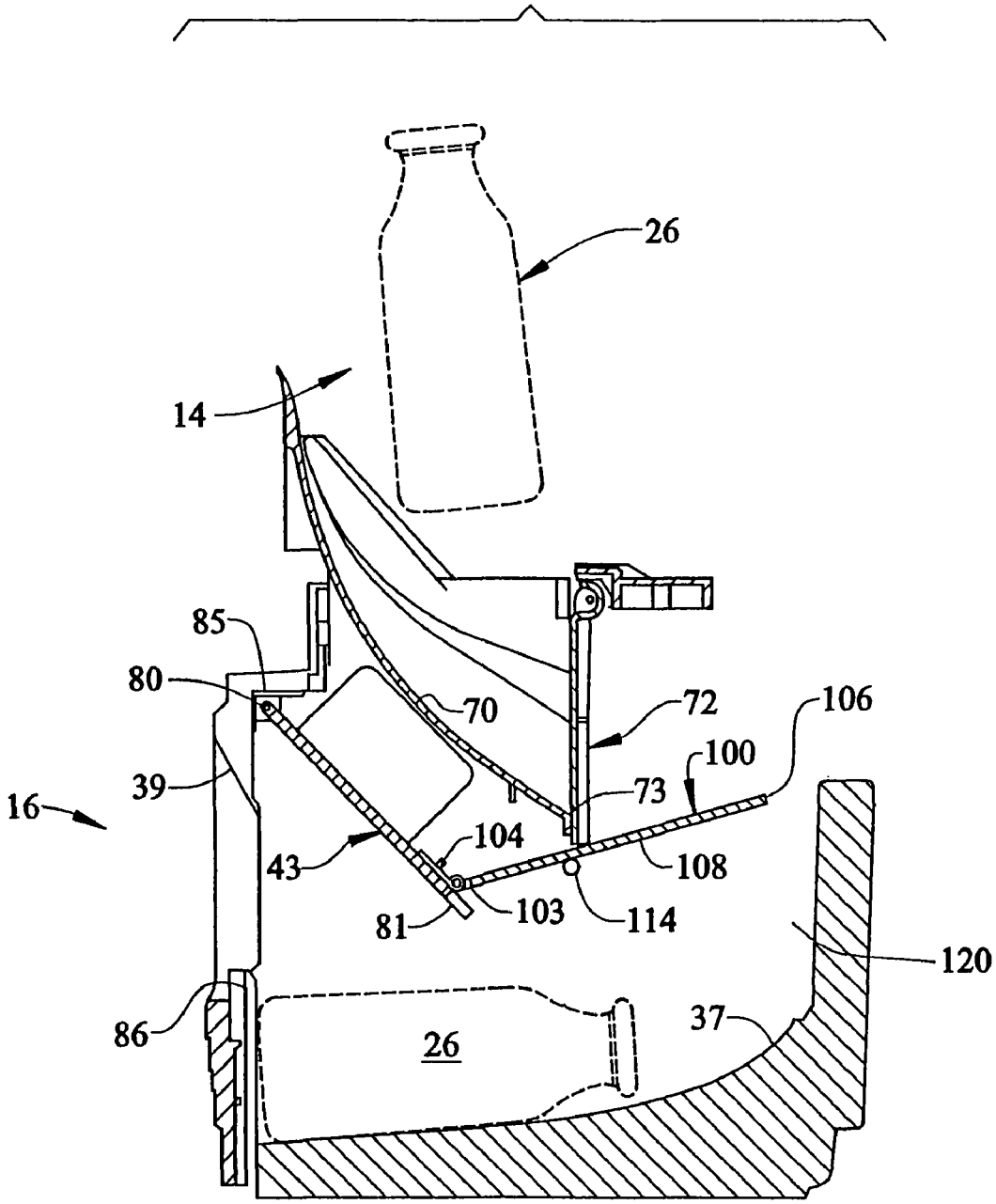
FIG. 4 is a partial, cross-sectional view of the dispensing chamber of FIG. 2, showing the anti-pilfer plate in a second or anti-pilfer position.

Reference will now be made to FIGS. 2-4 in describing further details of dispensing zone 16, and particularly dispensing chamber 37. Once a product container 26 is released from one of the plurality of product support shelves 20-24, the product container 26 falls, under the force of gravity, into a delivery chute 70 that opens into dispensing chamber 37. As shown, a product door 72 is pivotally mounted across delivery chute 70 so as to isolate storage/display zone 14 from dispensing zone 16. Toward that end, a seal 73 is arranged around an outer periphery of product door 72 so that refrigerated air, if present in storage/display zone 14, will not pass through delivery chute 70 into dispensing chamber 37. With this construction, product container 26 passing through delivery chute 70 will open product door 72 and pass into dispensing chamber 37. Once product container 26 has passed through delivery chute 70, product door 72 will close, either under the force of gravity or through the use of a biasing spring (not shown), to once again close off delivery chute 70.

In order to retrieve a vended product from dispensing zone 16, a consumer must access dispensing chamber 37 through, for example, delivery door 43. In accordance with a preferred form of the invention, delivery door 43 includes a first end 80 that extends to a second end 81 through an intermediate portion 83. First end 80 is pivotally mounted to an upper portion of delivery chamber 37 through a hinge 85, with second end 81 overlapping a lower lip portion 86 of product access opening 39 so that intermediate portion 83 effectively closes off dispensing chamber 37 as represented in FIG. 2. Without the present invention, after opening delivery door 43, a consumer could access, either manually or by using a tool, dispensing chamber 37 and retrieve product containers 26 from storage/display zone 14 without inserting or depositing currency into currency receiving center 50. Therefore, in accordance with the present invention, vending machine 2 is provided with an anti-pilfer plate 100 arranged so as to prevent unauthorized access to storage/display zone 14.

In accordance with the most preferred form of the present invention, anti-pilfer plate 100 includes a first end 103 pivotally mounted to second end 81 of delivery door 43 through a hinge mechanism 104. First end 103 leads to a second end 106 through an intermediate or blocking portion 108. When delivery door 43 is closed, anti-pilfer plate 100 enables free passage of product container(s) 26 into dispensing chamber 37 as represented in FIG. 2. Once delivery door 43 moves from the closed position, anti-pilfer plate 100 moves in unison into a second or product blocking position as represented from FIG. 3 to FIG. 4. That is, anti-pilfer plate 100 is directed over a guide element 114 such that second end 106 and blocking portion 108 prevent unauthorized access to storage/display zone 14. In accordance with one aspect of the invention, guide element 114 is constituted by a rod that projects generally perpendicularly from a side portion 120 of dispensing chamber 37. In still further accordance with the most preferred form of the present invention, anti-pilfer plate 100, when moved into the blocking position, actually prevents product door 72 from opening thus providing an even more restricted access to storage/display zone 14. With this particular construction, once delivery door 43 is moved from the closed position, unauthorized access to storage/display zone 14 is prevented. More specifically, the path traveled by a particular product container 26 from storage/display zone 14 into dispensing zone 16 is completely blocked so that either insertion of an arm or a tool is completely restricted.

As described, an anti-pilfering device constructed in accordance with the present invention will provide a mechanism that effectively seals off a storage region of a vending machine to prevent unauthorized access to products stored therein. Moreover, the anti-pilfering device will not only prevent entry of a hand or arm, but tools will be unable to pass into and retrieve products from the vending machine. Although described with reference to a preferred embodiment of the present invention, it should be readily apparent to one of ordinary skill in the art that various changes and/or modifications can be made to the invention without departing from the spirit thereof. For instance, the present invention can also be readily employed in solid front or other types of vending machines, including machines which employ mechanisms to transfer products to a dispensing region instead of relying on gravity. In addition, while the vending machine is depicted as having two product access openings, the anti-pilfer plate arrangement can work with any number of openings provided in the vending machine. In general, the invention is only intended to be limited to the scope of the following claims.

We claim:

1. A method for use with a vending machine comprising a product storage area, a product dispensing chamber from which a customer may retrieve a vended product, and a passage from the product storage area to the product dispensing chamber through which a vended product travels during vending, the method comprising:

configuring an anti-pilfer plate to move, in response to and concurrently with shifting of a product access door from a closed position blocking customer access to the product dispensing chamber to an open position allowing customer access to the product dispensing chamber, wherein the product access door has an upper end and a lower end and the anti-pilfer plate is pivotally coupled to at least one point at the lower end of the product access door, from a first position leaving at least a portion of the passage unobstructed to allow passage of a vended product from the product storage area to the product dispensing chamber to a second position wherein the anti-pilfer plate obstructs the passage, wherein movement of the product access door from the closed position to the open position laterally shifts the anti-pilfer plate in a direction parallel to a major surface of the anti-pilfer plate across the passage.

2. The method of claim 1, wherein the anti-pilfer plate is pivotally mounted to the lower end of the product access door.

3. The method according to claim 1, further comprising:

providing a guide element guiding the anti-pilfering plate for movement between the first and second positions.

4. The method according to claim 3, further comprising:

enabling sliding of the anti-pilfering plate upon the guide element.

5. The method according to claim 3, wherein the vending machine is a glass-front vending machine.

6. The method according to claim 3, further comprising a providing a product door moveable by a vended product traveling through the passage.

7. The method according to claim 6, wherein the anti-pilfer plate projects from the lower portion of the product access door upwardly and rearwardly into the dispensing chamber.

8. The method according to claim 4, wherein the guide element is a rod.

9. The method according to claim 8, wherein the rod projects substantially perpendicularly from a side portion of the dispensing chamber.

10. A system, comprising:

a product storage area of a vending machine, a product dispensing chamber of the vending machine from which a customer may retrieve a vended product, and a passage from the product storage area to the product dispensing chamber through which a vended product travels during vending;

a product access door configured to move from a closed position blocking customer access to the product dispensing chamber to an open position allowing customer access to the product dispensing chamber, wherein the product access door has an upper end and a lower end; and an anti-pilfer plate pivotally coupled to at least one point at the lower end of the product access door, wherein the anti-pilfer plate is configured to move simultaneously with shifting of the product access door from a first position leaving at least a portion of the passage unobstructed to allow passage of a vended product from the product storage area to the product dispensing chamber to a second position wherein the anti-pilfer plate obstructs the passage, wherein movement of the product access door from the closed position to the open position laterally shifts the anti-pilfer plate in a direction parallel to a major surface of the anti-pilfer plate across the passage.

11. The system of claim 10, wherein the anti-pilfer plate is pivotally mounted to the lower end of the product access door.

12. The system of claim 10, further comprising:

a guide element guiding the anti-pilfering plate for movement between the first and second positions.

13. The system to claim 12, wherein the anti-pilfering plate slides upon the guide element.

14. The system to claim 12, wherein the vending machine is a glass-front vending machine.

15. The system of claim 10, further comprising a product door moveable by a vended product traveling through the passage.

16. The method according to claim 15, wherein the anti-pilfer plate projects from the lower portion of the product access door upwardly and rearwardly into the dispensing chamber.

17. The system of claim 13, wherein the guide element is a rod.

18. The system of claim 17, wherein the rod projects substantially perpendicularly from a side portion of the dispensing chamber.

19. A method for use with a vending machine comprising a product storage area and a product dispensing chamber, the method comprising:

in response to a customer selection, delivering an item from the product storage area to the product dispensing chamber; and in response to movement of a product access door providing customer access to the item within the product dispensing chamber from a closed position to an open position, wherein the product access door has an upper end and a lower end, moving an anti-pilfer plate pivotally coupled to the lower end of the product access door to obstruct an opening through which items pass during delivery from the product storage area to the product dispensing chamber, wherein movement of the product access door from the closed position to the open position laterally shifts the anti-pilfer plate in a direction parallel to a major surface of the anti-pilfer plate across the opening.

20. The method of claim 19, wherein the anti-pilfer plate is pivotally mounted to a lower edge of the product access door.

* * * * *